US006672887B1

(12) United States Patent
Yu

(10) Patent No.: US 6,672,887 B1
(45) Date of Patent: Jan. 6, 2004

(54) ELECTRICAL CONNECTOR HAVING GROUNDING BRIDGE

(75) Inventor: Hung-Chi Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/328,599

(22) Filed: Dec. 23, 2002

(30) Foreign Application Priority Data

Dec. 13, 2002 (TW) ..... 91220226

(51) Int. Cl.[7] ..... H01R 13/652
(52) U.S. Cl. ..... 439/108; 439/609
(58) Field of Search ..... 439/108, 607, 439/608, 609, 660, 74, 92

(56) References Cited

U.S. PATENT DOCUMENTS 5,035,631 A * 7/1991 Piorunneck et al. ..... 439/108
5,913,690 A * 6/1999 Dechelette et al. ..... 439/108
5,993,257 A * 11/1999 Maruyama ..... 439/607
6,247,970 B1 * 6/2001 Ueno et al. ..... 439/608
6,390,833 B1 5/2002 Chang

* cited by examiner

*Primary Examiner*—Hien Vu
(74) *Attorney, Agent, or Firm*—WeiTe Chung

(57) ABSTRACT

An electrical connector (10) includes an insulative housing (11) having an elongated base wall (111) and a mating wall (112) projecting upwardly from the base wall (111), a plurality of terminals (12) received in the housing, a metallic shield (15) attached to an outer side of the insulative housing, and at least one grounding bridge (14) having a body portion (141) and a resilient arm (142) extending upwardly from the body portion. A pair of guiding column (1120, 1121) each defining a notch (1128) are provided on opposite ends of the mating wall of the housing. Each notch has an upper portion in the guiding column and a lower portion in the base wall and open to air from an upper surface of the base wall. The body portions of the grounding bridges are retained in the lower portions of the notches in the base wall and the resilient arms extend in the upper portions of the notches in the guiding column whereby the body portions of the grounding bridges electrically connect with the metallic shield from the upper surface of the base wall.

4 Claims, 6 Drawing Sheets

ELECTRICAL CONNECTOR HAVING GROUNDING BRIDGE

BACKGROUND OF THE INVENTION

1. Field of the Invention

The present invention relates to an electrical connector and particularly to an electrical connector having grounding bridges.

2. Description of Related Art

Electrical connectors usually have guiding columns to be inserted into guiding apertures of mating connectors for guiding the electrical connectors to engage with the mating connectors and grounding bridges provided on the guiding columns for making contact with grounding members of the mating connector for Electro-Static Discharge(ESD).

U.S. Pat. No. 6,390,833 discloses in FIGS. 7 and 8 thereof a connector 10 comprises a pair of metallic grounding pads 17 each providing a contacting portion 174 exposed from opposite ends of the housing 11 for electrically engaging with a shield 23 of a mating connector 20. The grounding pads 17 are inserted into cavities 128 of the housing 11 from a bottom face of the housing 11, and the grounding pads 17 are positioned in the cavities 128 by junctures 176 thereof upwardly abutting against blocks 125, 126 on opposite ends of the housing 11 and first feet 175 thereof pressing against an inner side of the shield 13 attached to an outer side of the housing 11. Sometimes, customers want electrical connectors with grounding pads thereof retained in other ways.

Hence, an electrical connector with improved grounding bridges is desired.

SUMMARY OF THE INVENTION

An object of the present invention is to provide an electrical connector having grounding bridges which can be reliably retained therein and which can assure an electrical connection thereof with a shield of a mating connector complementary to the electrical connector.

To achieve the above object, an electrical connector in accordance with the present invention comprises an insulative housing having an elongated base wall and a mating wall projecting upwardly from the base, a plurality of terminals received in the housing, a metallic shield attached to an outer side of the insulative housing, and a pair of grounding bridges each having a body portion and a resilient arm extending upwardly from the body portion. A pair of guiding columns each defining a notch are provided on opposite ends of the mating wall of the housing. Each notch has an upper portion in the guiding column and a lower portion in the base wall and open to air from an upper surface of the base wall. The body portions of the grounding bridges are retained in the lower portions of the notches in the base wall and the resilient arms extend in the upper portions of the notches in the guiding column whereby the body portions of the grounding bridges electrically connect with the metallic shield from the upper surface of the base wall.

Other objects, advantages and novel features of the invention will become more apparent from the following detailed description when taken in conjunction with the accompanying drawings.

DETAILED DESCRIPTION OF THE PREFERRED EMBODIMENTS

Figure 1:
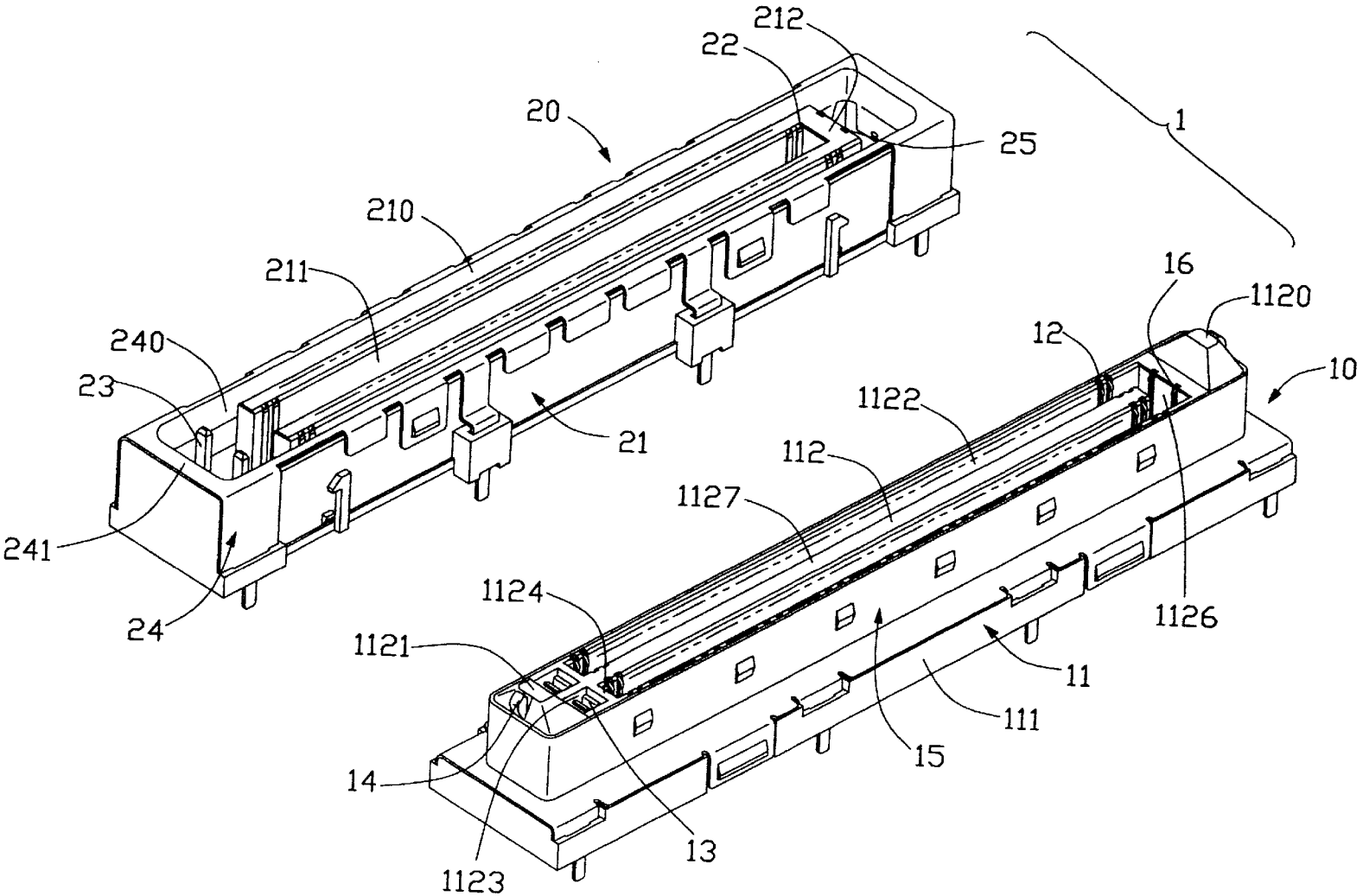
FIG. 1 is a perspective view of an electrical connector in accordance present invention and a mating connector complementary to the electrical connector.
Figure 2:
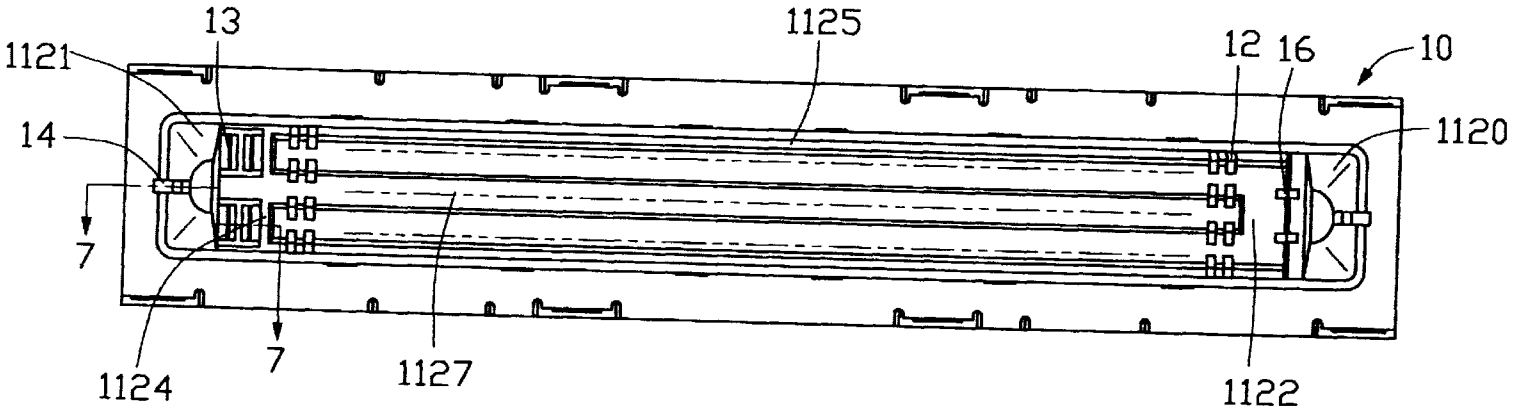
FIG. 2 is a top plan view of the electrical connector of FIG. 1.
Figure 3:
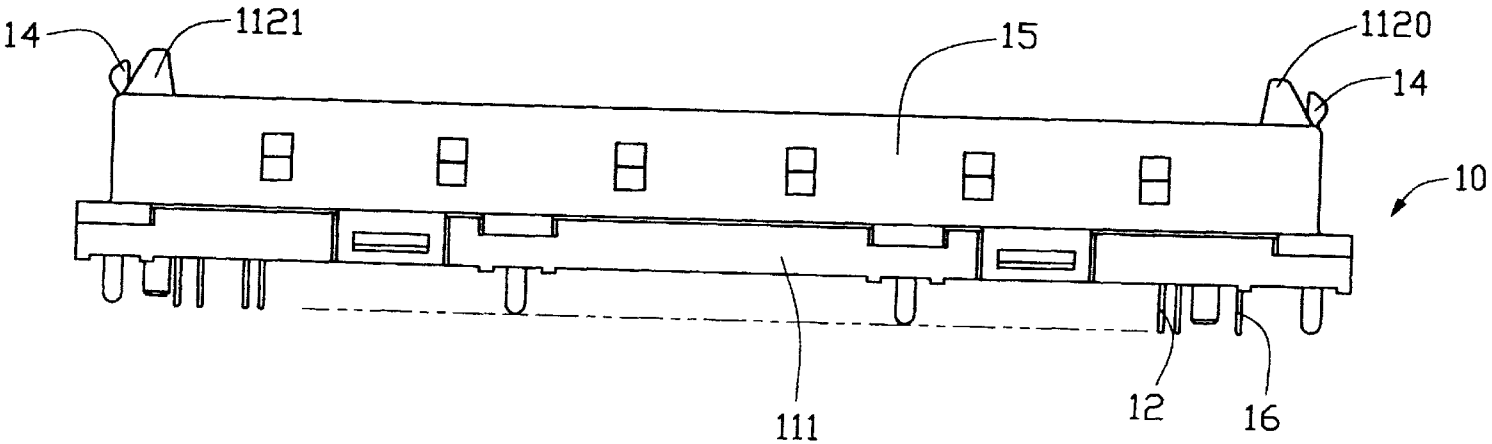
FIG. 3 is a front elevational view of the electrical connector of FIG. 2.
Figure 4:
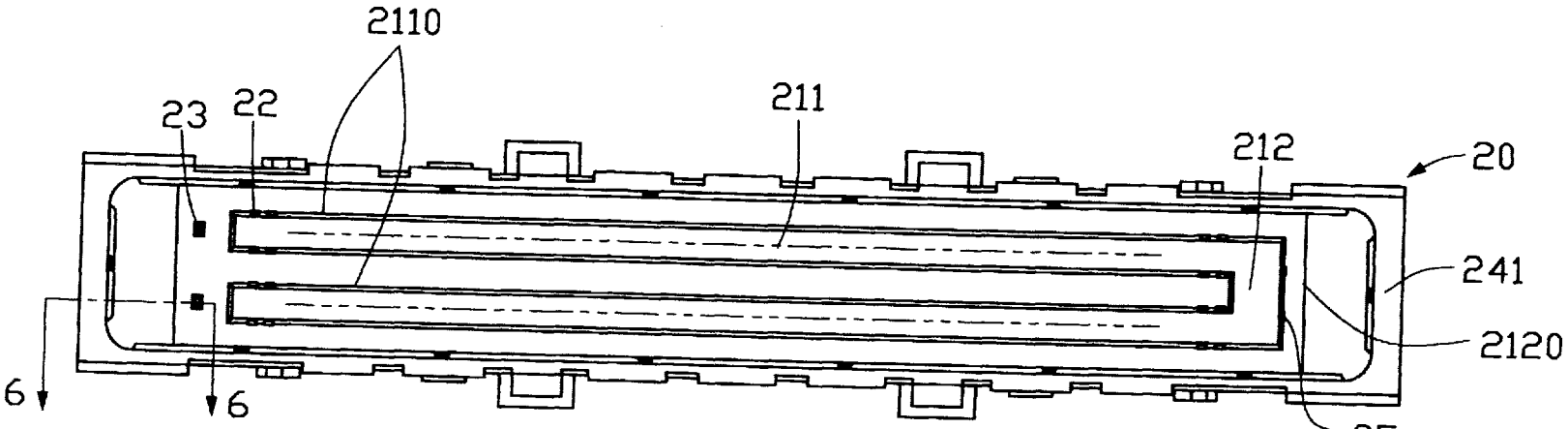
FIG. 4 is a top plan view of the mating connector of FIG. 1.
Figure 5:
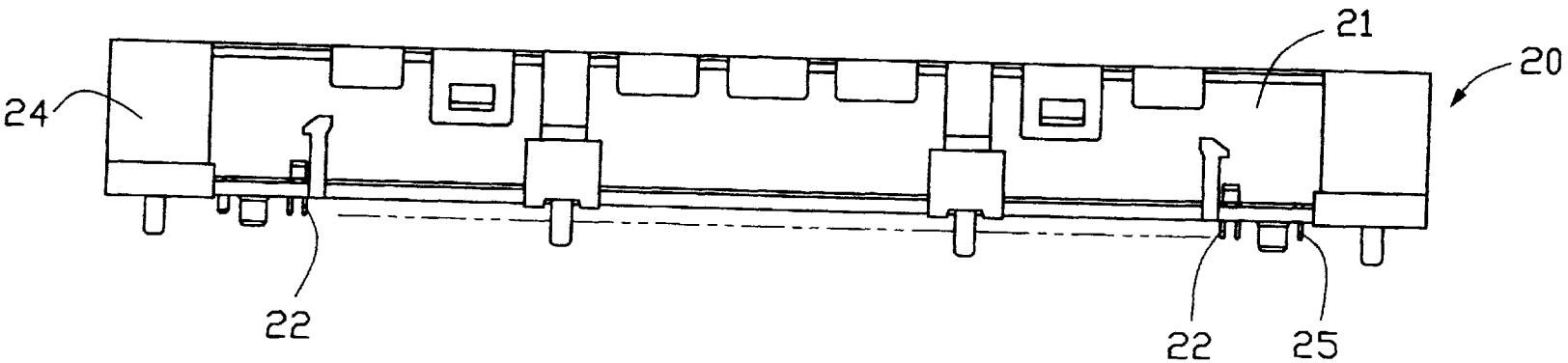
FIG. 5 is a front elevational view of the mating connector of FIG. 4.
Figure 6:
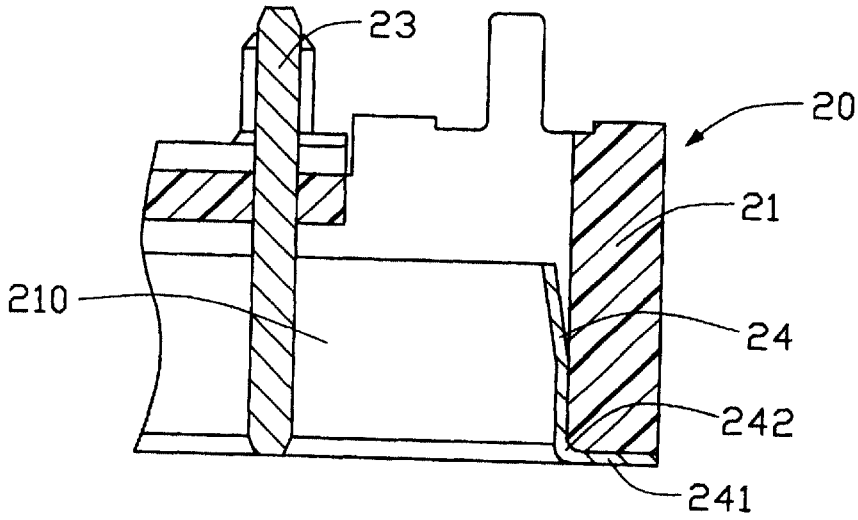
FIG. 6 is a cross-sectional view of the mating connector taken along line 6—6 of FIG. 4.

Referring to FIGS. 1, 2 and 3, an electrical connector 10 in accordance with the present invention is adapted to mate with a mating connector 20 complimentary to the electrical connector 10 and together with the mating connector 20 configures an electrical assembly 1.

The electrical connector 10 comprises an insulative housing 11, a plurality of terminals 12 received in the insulative housing 11, a pair of metallic power clips 13 located at one end of the housing 11, a pair of L-shaped grounding bridges 14, and a metallic shield 15 attached to an outer side of the housing 11.

The insulative housing 11 includes an elongated base wall 111 and a mating wall 112 projecting upwardly from the base wall 111. The mating wall 112 defines, between a distal guiding column 1120 and a proximate guiding column 1121 opposing the distal guiding column 1120, a longitudinal first receiving cavity 1122 and a pair of second receiving cavity 1123 separated from the first receiving cavity 1122 by a baffle wall 1124. Two rows of terminal passageways are defined in opposite inner side walls 1125 of the mating wall 112. Moreover, two auxiliary terminal passageways are defined in an inner side 1126 of the distal guiding column 1120. A tongue 1127 extends from the baffle wall 1124 toward the distal guiding column 1120 and defines two rows of terminal passageways in opposite outer sides thereof. The tongue 1127 is parallel to the side walls 1125.

Figure 7:
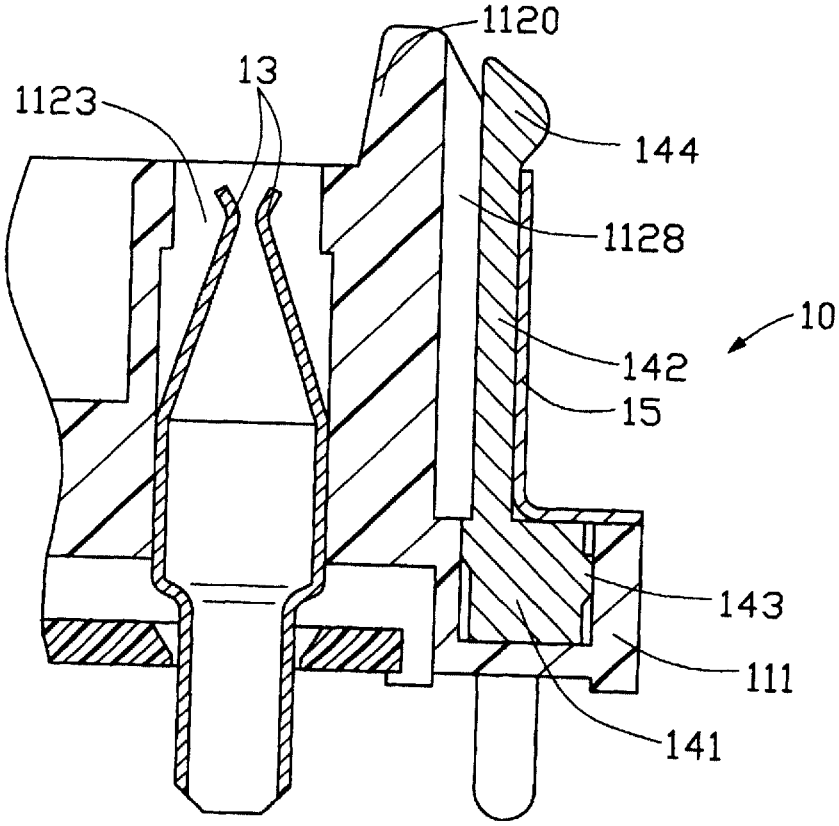
FIG. 7 is a cross-sectional view of the electrical connector taken along line 7—7 of FIG. 2.

Further referring to FIG. 7, each guiding column 1120, 1121 defines an L-shaped notch 1128 (only one is shown) extending downwardly from a top end thereof into but not throughout the base wall 111. The lower portions of the notches 1128 in the base wall 111 are slightly longitudinally offset from the upper portions of the notches 1128. The upper portions of the notches 1128 open to air from outer sides of the guiding columns 1120, 1121 and the lower portions of the notches 1128 open to air from the upper surface of the base wall 111.

Each L-shaped grounding bridge 14 has a body portion 141 and a resilient arm 142 extending upwardly from the body portion 141. A pair of barbs 143 are formed on opposite sides of the body portion 141. The resilient arm 142 has a transversely enlarged contacting portion 144 on a free end thereof.

In assembly, the terminals 12 are received in the terminal passageways in the opposite side walls 1125 of the mating wall 112 and the outer sides of the tongue 1127. Two auxiliary terminals 16 are received in the terminal passageways in the inner side 1126 of the distal guiding column 1120. Each first power clip 13 is received in a second receiving cavity 1123. The grounding bridges 14 are inserted into the notches 1128 from the top ends of the guiding columns 1120, 1121. The body portions 141 are received in lower portions of the notches 1128 in the base 111 with the barbs 143 engaged with the base wall 111. The resilient arms 142 extend in the upper portions of the notches 1128. The metallic shield 15 is attached to an outer side of the housing 11 with the contacting portions 144 of the grounding bridges 14 upwardly and outwardly protruding beyond the shield 15. The grounding bridges 14 electrically connect with the shield 15 from the outer sides of the guiding columns 1120, 1121 and the upper surface of the base wall 111. Since the lower portions of the notches 1128 in the base wall 111 are longitudinally offset from the upper portions of notch 1128 in the guiding column 1120, 1121, the resilient arms 142 of the grounding bridges 14 are able to resiliently move in a longitudinal direction of the mating wall 112.

As is shown in FIGS. 1, 4, 5 and 6, the mating connector 20 comprises a dielectric mating housing 21, a plurality of mating terminals 22, a pair of power contacts 23, a metallic mating shield 24 attached to the mating housing 21 and two auxiliary mating terminals 25.

The mating housing 21 is elongated and defines an upward facing recess 210. Two parallelly arranged mating tongues 211 are located in the recess 210 with their distal ends being perpendicularly interconnected by a bridge wall 212. The mating tongues 211 and the bridge wall 212 are adapted to be received in the first receiving cavity 1122. Each mating tongue 211 defines engaging surfaces 2110 on opposite sides thereof and the bridge wall 212 defines a contacting surface 2120 merely on a side facing the distal guiding column 1120. The mating terminals 22 are positioned on the engaging surface 2110 of the mating tongues 211 whereas two auxiliary mating terminals 25 are positioned on the contacting surface 2120.

The power contacts 23 are located an end of the recess 210 far away from the bridge wall 212.

The mating shield 24 has a peripheral wall 240 wrapping an inner side of the recess 210 and two flanges 241 covering opposite ends of an upper surface of the mating housing 21. The flanges 241 perpendicularly join to the peripheral wall 240 at joints 242.

Figure 8:
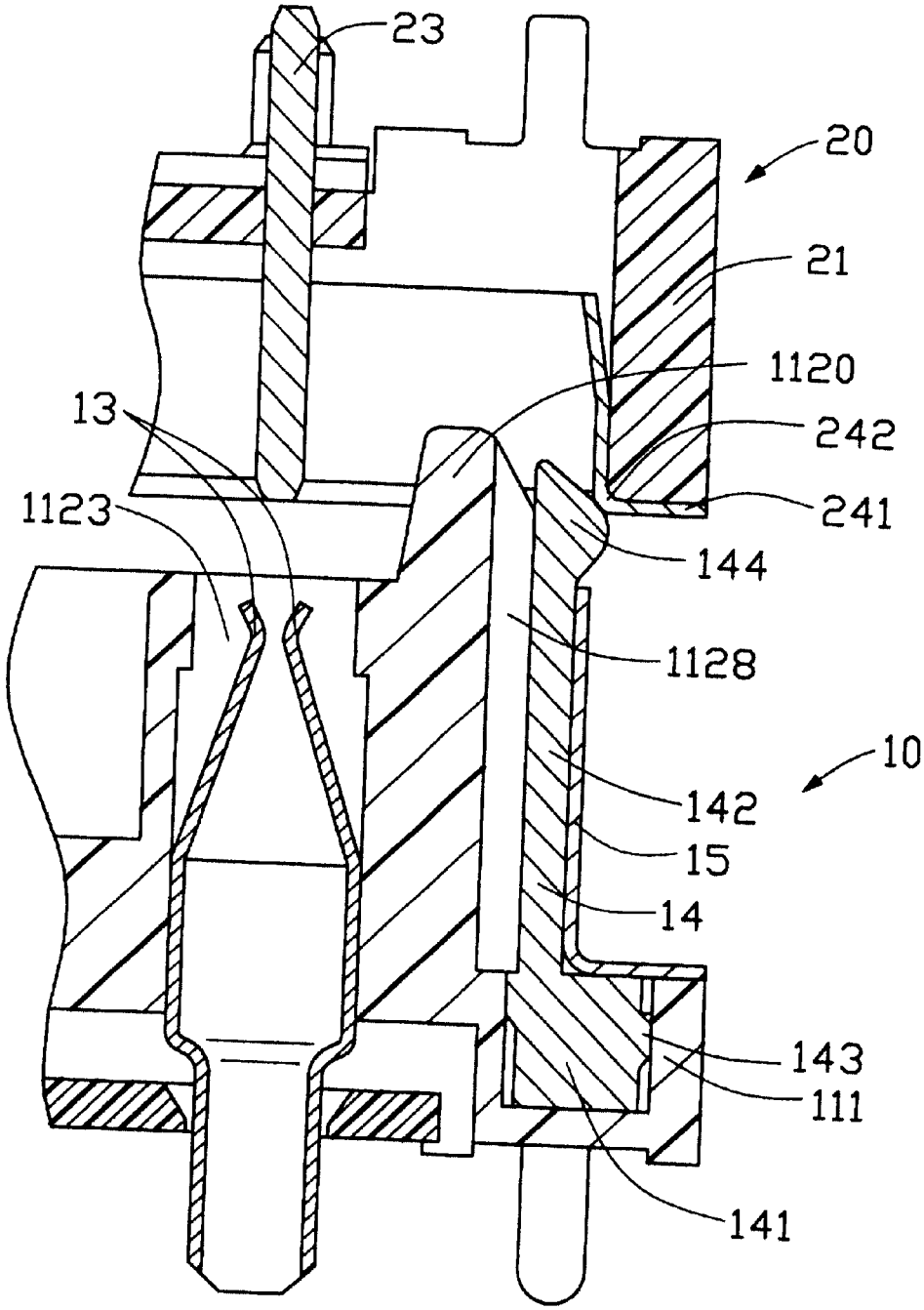
FIG. 8 is a view similar to FIG. 7 with the mating connector of FIG. 6 shown.
Figure 9:
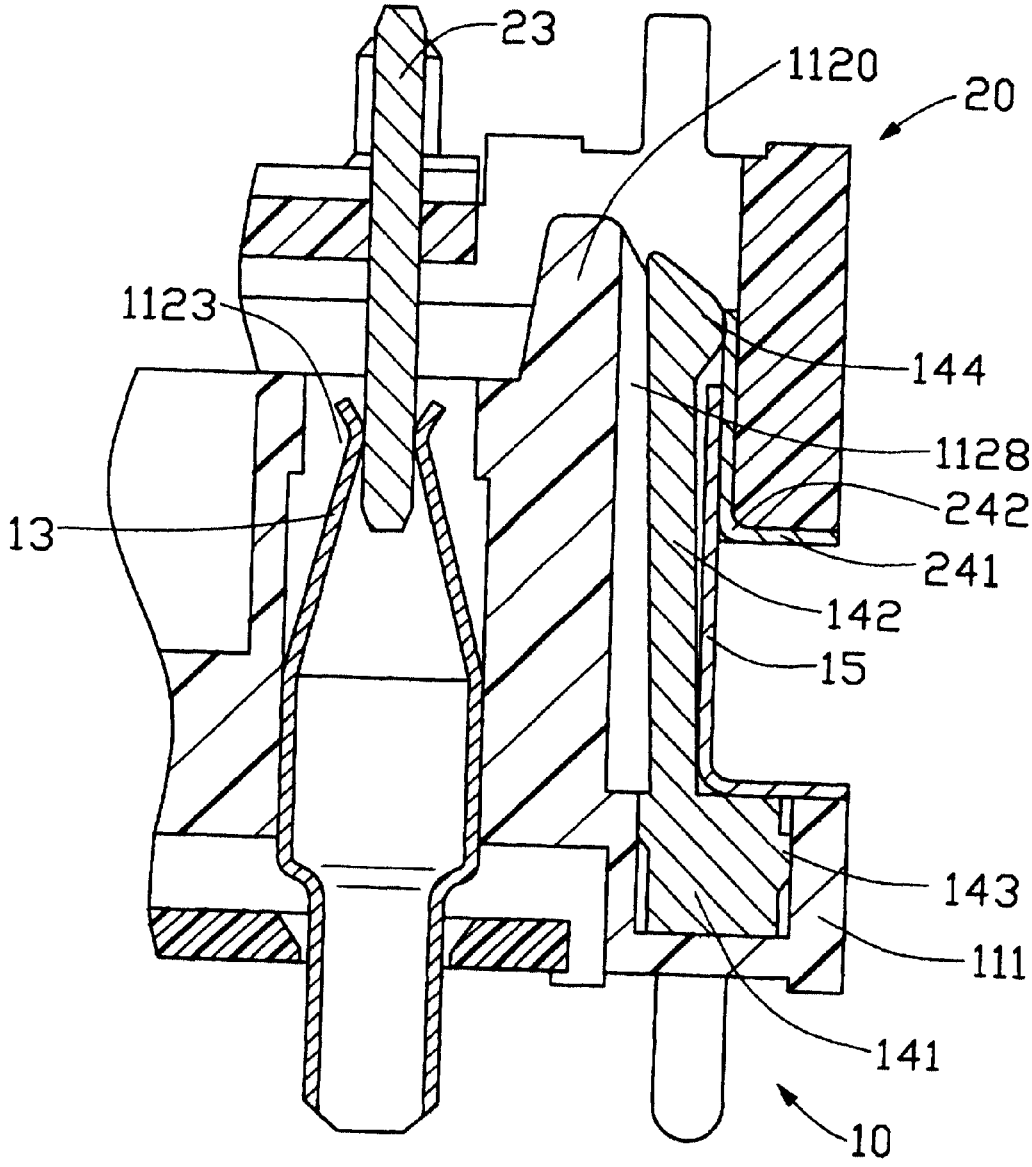
FIG. 9 is a view similar to FIG. 8, showing the electrical connector and the mating connector haven been engaged.

When the electrical connector 10 and the mating connector 20 are engaged, as is shown in FIGS. 8 and 9, the joints 242 of the mating shield 24 contact the contacting portions 144 of the grounding bridges 14 of the electrical connector 10 before the terminals 22, 25 and the power contacts 23 of the mating connector 20 engage with corresponding terminals 12, 16 and power clips 13 of the electrical connector 10. Therefore, the static electronics deposited on the connectors 10, 20 are discharged prior to data transmitting and power current flowing between the electrical connector 10 and mating connector 20. Since the body portions 141 of the grounding bridges 14 are received and secured in the lower portion of the notch 1128 in the base wall 111, a reliable electrical connection between the grounding bridges 14 and the mating shield 24 is got. The two mating tongues 211 sandwiches the tongue 1127 so that the terminals 12 engage with the corresponding mating terminals 22 for data transmitting. Meanwhile, the contacting surface 2120 of the bridge wall 212 engages with the inner side 1126 of the distal guiding column 1120 such that the auxiliary terminals 16 engage with corresponding auxiliary mating terminals 25 for data transmitting. The power contacts 23 of the mating connector 20 are clipped by the power clips 13 of the electrical connector 10 for power current flowing therethrough.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector having a shield on peripheral sides, comprising:

an insulative housing comprising an elongated base wall, a mating wall projecting upwardly from the base wall, a receiving cavity extending in the mating wall, a guiding column provided on the mating wall, and a notch having an upper portion in the guiding column and a lower portion in the base wall and open to air from an upper surface of the base wall;

a plurality of terminals being positioned in the mating wall and exposed to the receiving cavity;

a metallic shield attached to the insulative housing; and a grounding bridge having a body portion secured in the lower portion of the notch and a resilient arm extending in the upper portion of the notch, the body portion of the grounding bridge electrically connecting with the metallic shield from the upper surface of the base wall; wherein the lower portion of the notch in the base wall is slightly longitudinally offset from the upper portion of the notch in the guiding column and the grounding bridge is resiliently moveable in a longitudinal direction of the mating wall; wherein the grounding bridge has a pair of barbs on opposite sides of the body portion to engage with the base wall.

2. The electrical connector as claimed in claim 1, wherein the grounding bridge has a contacting portion upwardly and outwardly protruding beyond the metallic shield for making contact with the shield of the complementary connector.

3. An electrical connector assembly comprising:

a first connector including:

a first insulative housing including a base an elongated base wall and an island-like forwardly extending mating portion extending therefrom;

a plurality contacts disposed in the first housing;

a first metallic shell including a horizontal section vertically covering said base and a vertical section horizontally covering said mating portion;

an upward recess formed in each of two opposite lengthwise ends of the first housing;

a grounding bridge downwardly inserted into the recess and including a retention section retained in the end and vertically restrained by said horizontal section of the first shell, and a spring arm extending upwardly from the retention section with a distal end extending upwardly and outwardly beyond a top edge of the vertical section of the first shell in both vertical and lateral directions; and a second connector mated with said first connector and including a second insulative housing enclosed in a second metallic shell; wherein said distal end of the spring arm abuts against the second shell and is forced to inwardly deflected by said second shell; wherein the grounding bridge has a pair of barbs on opposite sides of the body portion to engage with the base wall.

4. The assembly as claimed in claim 3, wherein a guide column is integrally formed adjacent to each of said ends of the first housing in communication with the corresponding recess, and wherein the spring arm of the corresponding grounding bridge aside is partially hidden in said guiding column.

* * * * *